US012116872B1

(12) United States Patent
McChesney et al.

(10) Patent No.: US 12,116,872 B1
(45) Date of Patent: Oct. 15, 2024

(54) DOWNHOLE FLOW CONTROL DEVICE WITH TURBINE CHAMBER INSERT

(71) Applicant: Halliburton Energy Services, Inc., Houston, TX (US)

(72) Inventors: Ryan W. McChesney, Carrollton, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/133,284

(22) Filed: Apr. 11, 2023

(51) Int. Cl.
*E21B 43/12* (2006.01)
*E21B 41/00* (2006.01)

(52) U.S. Cl.
CPC ..... *E21B 43/12* (2013.01); *E21B 41/0085* (2013.01)

(58) Field of Classification Search
CPC .. E21B 43/12; E21B 41/0085; E21B 2200/02; E21B 2200/06
See application file for complete search history.

(56) References Cited

U.S. PATENT DOCUMENTS

| | | | |
|---|---|---|---|
| 4,729,715 A | 3/1988 | Wide | |
| 5,839,508 A | 11/1998 | Tubel et al. | |
| 7,189,055 B2 | 3/2007 | Marini et al. | |
| 8,356,668 B2 | 1/2013 | Dykstra et al. | |
| 10,233,901 B2 | 3/2019 | Tay et al. | |
| 2006/0269398 A1 | 11/2006 | Marini et al. | |
| 2013/0017063 A1 | 1/2013 | Tay et al. | |
| 2013/0220633 A1 | 9/2013 | Felten | |
| 2016/0177773 A1* | 6/2016 | Chochua | E21B 4/02 415/148 |
| 2018/0245403 A1* | 8/2018 | Chambers | H02K 7/1823 |
| 2021/0131204 A1* | 5/2021 | Marshall | E21B 41/0085 |
| 2022/0356803 A1* | 11/2022 | Guelat | E21B 47/13 |
| 2023/0366291 A1* | 11/2023 | Fripp | E21B 34/063 |

FOREIGN PATENT DOCUMENTS

JP 2005076931 A 3/2005

OTHER PUBLICATIONS

International Search Report and Written Opinion for International Patent Application No. PCT/US2023/021820 dated Jan. 10, 2024. PDF file. 9 pages.

* cited by examiner

*Primary Examiner* — Brad Harcourt
(74) *Attorney, Agent, or Firm* — Scott Richardson; C. Tumey Law Group PLLC

(57) ABSTRACT

A downhole flow control device is used to control the production of formation fluids while using flow of the formation fluids to drive a turbine. Flow through a turbine chamber is optimized using a chamber insert that cooperatively defines a reduced chamber volume with the turbine chamber. The chamber insert includes an overhead portion defining a ceiling over the turbine and an arcuate portion contiguous with an arcuate portion of the turbine chamber. The baffle is perforated to allow some flow to exit the reduced chamber volume to a bypass port in a cavity radially outwardly thereof. The turbine may be used for any suitable downhole application, such as an inflow control device or to generate electrical power.

20 Claims, 7 Drawing Sheets

DOWNHOLE FLOW CONTROL DEVICE WITH TURBINE CHAMBER INSERT

BACKGROUND

Production tubing and other equipment can be installed in a wellbore of a well system (e.g., an oil or gas well) for communicating fluid in the wellbore to the well surface. The resulting fluid at the well surface is referred to as production fluid. Production fluid can include a mix of different fluid components, such as oil, water, and gas, and the ratio of the fluid components in the production fluid can change over time. This can make it challenging for a well operator to control which types of fluid components are produced from the wellbore. For example, it can be challenging for a well operator to produce mostly oil from the wellbore, while reducing or eliminating the production of gas or water from the wellbore.

BRIEF DESCRIPTION OF THE DRAWINGS

These drawings illustrate certain aspects of some of the embodiments of the present disclosure and should not be used to limit or define the method.

DETAILED DESCRIPTION

A downhole flow control device is disclosed for controlling the production of formation fluids while using flow of the formation fluids to drive a turbine in a turbine chamber. Flow through the turbine chamber is optimized using a chamber insert. The chamber insert and the housing cooperatively define a reduced chamber volume for optimizing flow about the turbine. A housing of the flow control device defines a first arcuate portion of the reduced chamber volume. A baffle of the chamber insert defines a second arcuate portion contiguous with the first arcuate portion to fully encircle the turbine and to cordon off a cavity in the turbine housing radially outward of the reduced chamber volume. The baffle is perforated to allow some flow to the cavity leading to a bypass port. An overhead portion of the baffle defines a ceiling extending in parallel to a top of the turbine, which cordons off an arched portion defined by the housing over the turbine.

The reduced chamber volume defined in part by the first arcuate portion of the housing, the second arcuate portion of the baffle, and the ceiling defined by the overhead portion, together define a substantially cylindrical chamber volume about the turbine. This arrangement improves flow dynamics about the turbine to improve turbine performance and efficiency. The turbine may be used for any of a variety of applications, such as an inflow control device or electrical power generation. Non-limiting example configurations are provided below with reference to the following figures.

Figure 1:
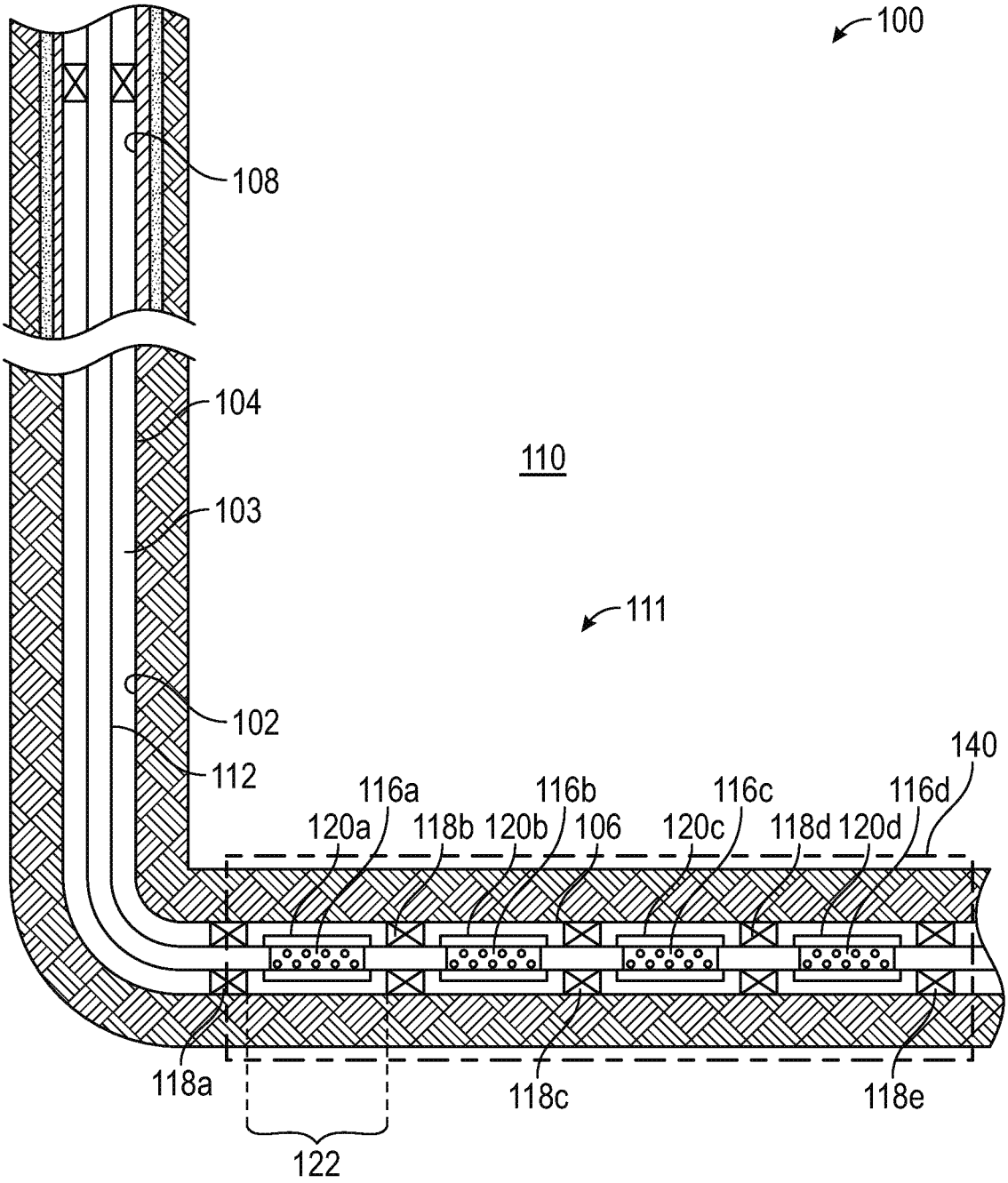
FIG. 1 is an elevation view of an example of a well system in which a flow control system may be implemented according to aspects of this disclosure.

FIG. 1 is an elevation view of an example of a well system 100 in which a flow control system 140 may be implemented according to aspects of this disclosure. This figure is simplified in some respects for discussion, and is not to scale. The well system 100 includes a wellbore 102 extending through various earth strata of a subterranean formation 110. The wellbore 102 may follow any suitable wellbore trajectory to reach a desired production zone 111 of the formation 110. The trajectory may include an initial vertical wellbore section and one or more deviated sections employing directional drilling techniques. In this simplified example, the wellbore 102 has an initial, substantially vertical section 104 that transitions to a substantially horizontal section 106 traversing the production zone 111. Portions of the wellbore may be cased for reinforcement, while other portions may be substantially non-reinforced, i.e., open hole. Here, the substantially vertical section 104 may include a string of casing 108 cemented at an upper portion of the substantially vertical section 104, while the horizontal section 106 traversing the production zone 111 is open hole.

A tubing string 112 extends from an above ground location (i.e., a surface of the well site) along the wellbore 102, defining an annulus 103 between the tubing string 112 and the wellbore 102 along the open hole portions and with the casing 108 along the cased portions. The tubing string 112 may be included with an upper completion that can provide a conduit for fluid (e.g., production fluid) to travel from the substantially horizontal section 106 to the well's surface. The tubing string 112 can include any number of production tubular sections 116, examples of which are individually indicated at **116*a*-116*d*, at various production intervals adjacent to the subterranean formation 110. A corresponding number of packers 118, individually indicated at 118*a*-118*e*, can be positioned on opposing sides of production tubular sections to define production intervals (e.g., production interval 122) and provide fluid seals between the tubing string 112 and the wall of the wellbore 102**.

Any number of inflow control devices (ICDs) 120, individually indicated at **120*a*-120*d*, may be included for production of formation fluids into the tubular sections 116. The inflow control devices 120 are examples of downhole flow control devices that can be included with the flow control system 140 and which can utilize a turbine as further disclosed below. Generally, inflow control devices are used to control the flow of formation fluid from a production interval into a production tubular section. Generally, an ICD may create a pressure drop, which may be used, for example, to help balance the influx of production fluids from a length of a horizontal section to reduce heel-toe effects, or to slow the flow from a highly permeable zone in an effort delay water or gas breakthrough. Although not required, some ICDs may be autonomous ICDs (i.e., AICDs) that are additionally capable of autonomously restricting undesired fluid or fluid components to a greater extent. ICDs 120 may be used individually to restrict the flow of certain fluid components, thereby collectively increasing a proportion of desired fluid components. For example, the production interval 122 may produce formation fluid having more than one type of fluid component, such as oil, water, carbon dioxide, and natural gas. Each inflow control device 120 uses the properties of different fluid components such as density and/or viscosity to reduce or restrict the flow of fluid of less desirable fluid components (e.g., water and CO2) into the production tubular section 116 while collectively producing a higher proportion of a more desirable fluid components, such as oil. In some examples, the inflow control devices 120 can be autonomous inflow control devices (AICDs) that can allow or restrict fluid flow into the production tubular sections 116** based on fluid properties such as density, viscosity, etc., without requiring signals from the well's surface by the well operator.

For ease of illustration, FIG. 1 depicts each production tubular section 116 as having an inflow control device 120. However, a given zone or production tubular section may have more than one ICD, and not every zone or production tubular section is required to have an inflow control device 120. Also, the production tubular sections 116 (and the inflow control devices 120) can be located in the substantially vertical section 104 additionally or alternatively to the substantially horizontal section 106. Further, any number of production tubular sections 116 with inflow control devices 120 can be used in the well system 100. In some examples, production tubular sections 116 with inflow control devices 120 can be disposed in simpler wellbores, such as wellbores having only a substantially vertical section 104. The inflow control devices 120 can be disposed in cased wells or in open-hole environments.

Figure 2:
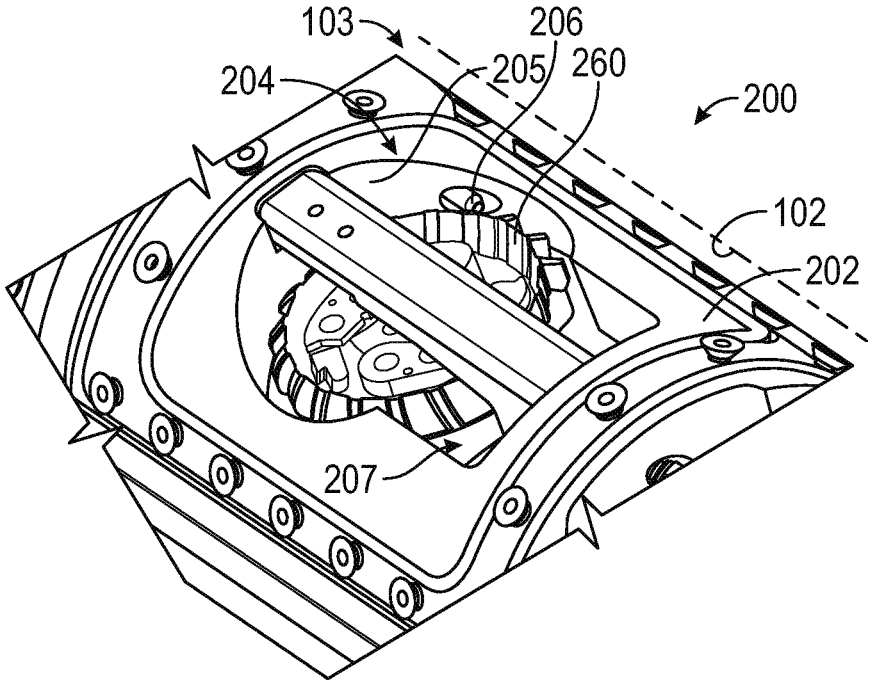
FIG. 2 is a perspective top view of a flow control device according to an example configuration.

FIG. 2 is a perspective top view of a flow control device 200 according to an example configuration with an available chamber insert omitted from view. The flow control device 200 includes a housing 202, which may be mounted and carried on a tubing string, such as on a lower completion for positioning in a production zone of a well. The housing 202 is positionable in a well. For example, the housing 202 has a generally circular cross-section, which facilitates positioning and lowering the flow control device 200 into a generally circular wellbore 102 to define the annulus 103 therebetween. The housing 202 has a turbine chamber 204 for receiving a turbine 260 rotatably disposed in the turbine chamber 204. A chamber insert 230 discussed below in relation to subsequent figures may also be installed in the turbine chamber 204. The turbine chamber 204 includes a first arcuate portion 205 defined by the housing 202 that partially encircles a turbine 260. The first arcuate portion may be an incomplete portion of a cylindrical chamber wall that opens up to a cavity 207 of the turbine chamber 204.

Formation fluids enter the housing 202 and pass through the turbine chamber 204 of the flow control device 200 before entering a production conduit (e.g., production tubing string). In particular, an inlet port 206 to the turbine chamber 204 is in fluid communication with the annulus 103 about the housing 202. One or more outlet port (discussed below and shown in subsequent figures) provides fluid communication between the turbine chamber 204 and a production conduit, such as the production tubular sections 116 of FIG. 1. The inlet port 206 is directed toward the turbine 260 such that flow of formation fluid through the turbine chamber 204 rotates the turbine 260. That turbine rotation may be used for any of a variety of downhole applications. For example, as further discussed below, rotation of the turbine 260 may be used to selectively restrict the flow of certain fluid components as part of an inflow control device and/or to generate electrical energy downhole as a component of an electrical generator. Thus, it is desirable to maximize the efficiency of the turbine 260 such as by streamlining flow around the turbine 260 as described herein.

Figure 3:
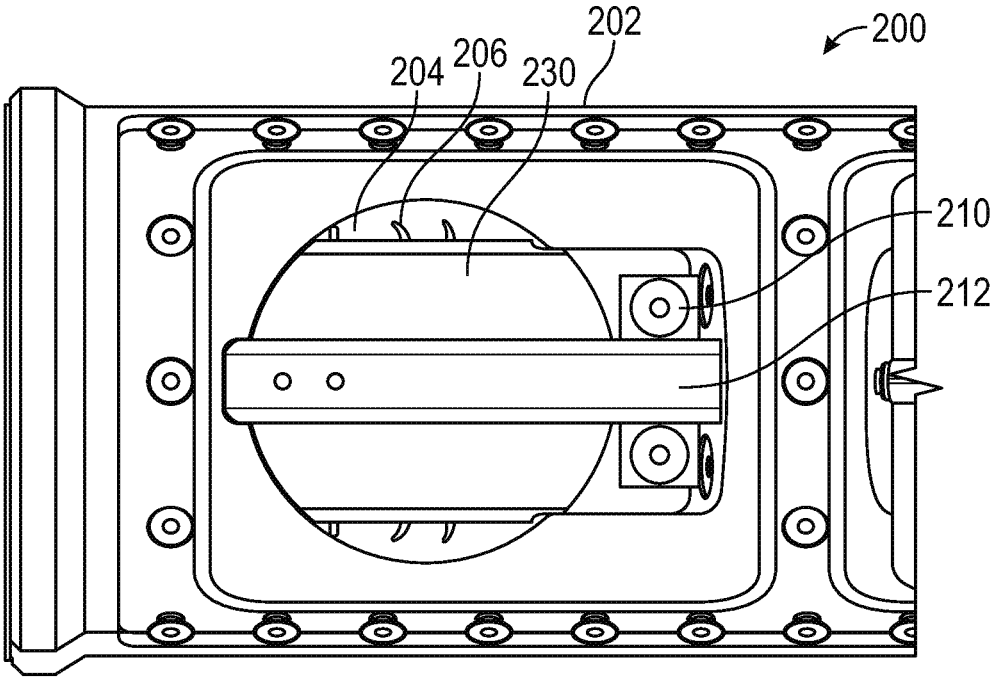
FIG. 3 is a top view of the flow control device with a chamber insert removably installed in the turbine chamber.

FIG. 3 is a top view of the flow control device 200 with a chamber insert 230 according to this disclosure removably installed in the turbine chamber 204 over the turbine 260. The chamber insert 230 and the housing 202 cooperatively define a reduced chamber volume having a geometry that improves flow through the turbine chamber 204. The flow control device 200 works even without the chamber insert 230 installed, including generating rotation of the turbine 260 in response to flow. However, the addition of the chamber insert 230 improves flow, such as to drive rotation of the turbine 260 with better efficiency as compared with not using the chamber insert 230. The chamber insert 230 may be removably secured in the turbine chamber 204 in any suitable manner, which may depend on the configuration of the housing 202 and chamber insert 230. In this example, the chamber insert 230 may be quickly and easily, yet securely, installed in the turbine chamber 204 with just a few fasteners 210. This example also uses a crossbar 212 over the chamber insert 230 through which the fasteners 210 are threadedly engaged with the housing 202. However, an alternate configuration may secure a chamber insert directly to the housing without the crossbar 212.

Figure 4:
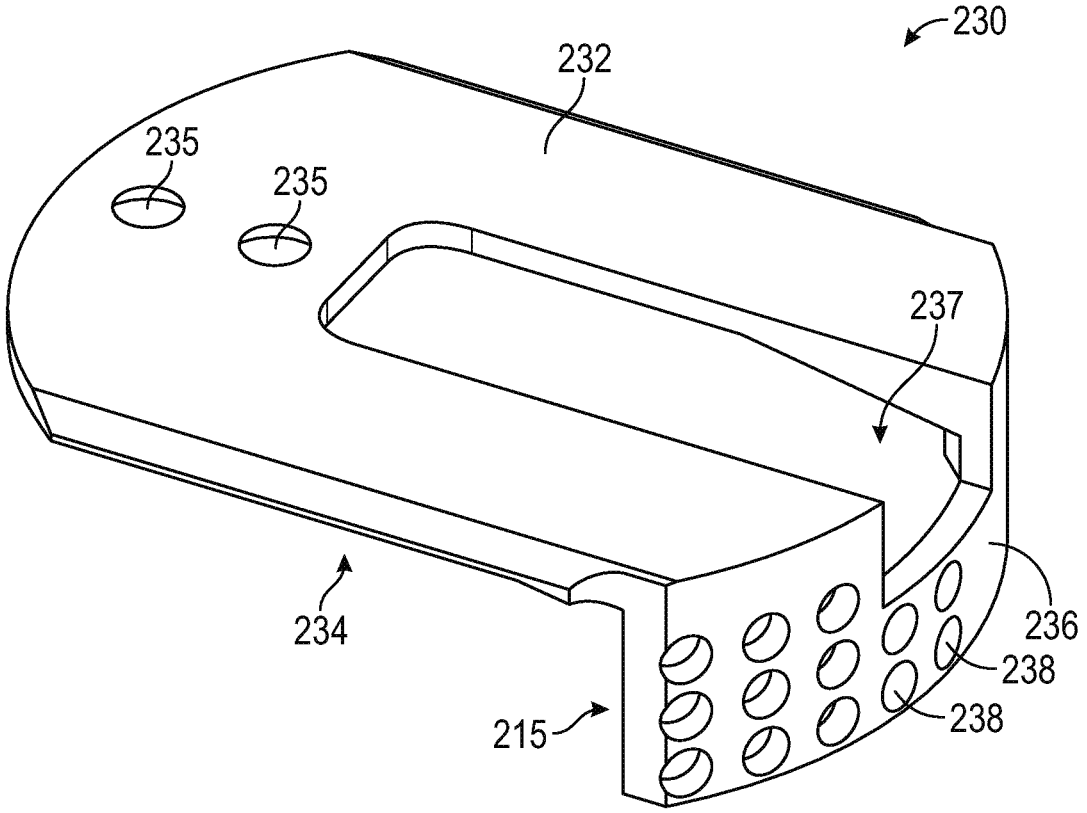
FIG. 4 is a perspective top view of the chamber insert according to an example configuration.

FIG. 4 is a perspective top view of the chamber insert 230 according to an example configuration. The chamber insert 230 includes an overhead portion 232 and a perforated baffle 236 that extends orthogonally to the overhead portion 232. The overhead portion 232 will extend over a turbine to define a ceiling 234 over the turbine. A pair of mounting holes 235 are provided for receiving fasteners to secure the chamber insert 230 within the housing. The chamber insert 230 may be a rigid structure, such as by unitarily forming the perforated baffle 236 with the overhead portion 232. The chamber insert 230 may be formed of any suitable material, such as a corrosion-resistant alloy, plastic, polymer, or molded composite. When installed in a turbine chamber, the ceiling 234 will extend generally parallel top a top of the turbine. The baffle 236 will provide a second arcuate portion 215 of a cylindrical reduced chamber volume about the turbine. A plurality of perforations 238 on the baffle 236 allow some fluid to pass through the baffle 236 to a downstream port (e.g., a bypass port) that allows flow to exit the turbine chamber. The perforations 238 may comprise any material with perforations 238 (e.g., individually formed holes, screen, a mesh, or other permeable member). The housing could alternatively have an exit port in another area to avoid the need for a perforated portion.

Figure 5:
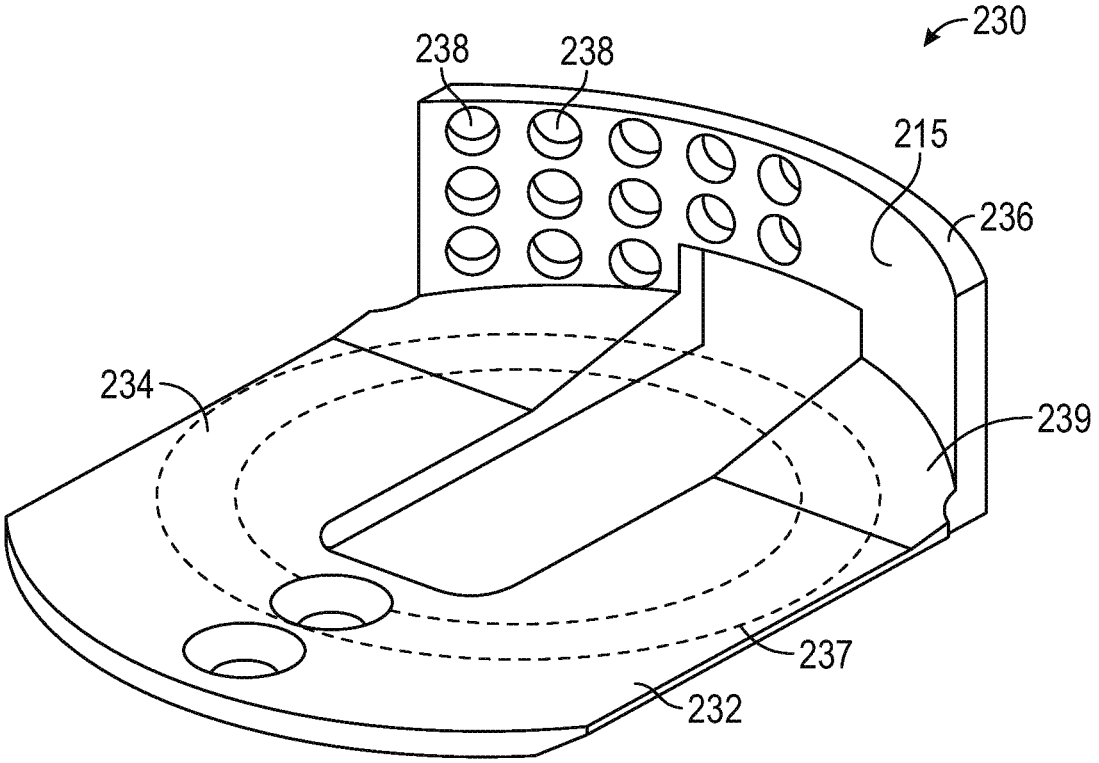
FIG. 5 is a perspective bottom view of the chamber insert of FIG. 2.

FIG. 5 is a perspective bottom view of the chamber insert 230. The ceiling 234 faces upwardly in this view, revealing a generally flat structure that may traverse a turbine chamber parallel to a top face of a turbine. The generally flat structure may help minimize drag and/or streamline flow. Alternatively, the ceiling could alternatively have arcuate vanes projecting from the ceiling 234 to promote a uniform circular flow profile for the fluid. A footprint for arcuate vanes is schematically indicated in dashed line type at 237. The overhead portion 232 in this example also includes a taper or other transition 239 to the baffle 236, such as to provide structural rigidity to the chamber insert 230 or to further refine a resulting chamber volume about the turbine. In this example, the perforations 238 are circular and regularly spaced. However, other configurations may use different sizes, shapes, arrangements, and spacings of perforations. The total cross-sectional area of the perforations 238 may be optimized to allow formation fluids to pass through the baffle 236, without appreciably disrupting the circumferential flow about the turbine along the second arcuate portion 215.

Figure 6:
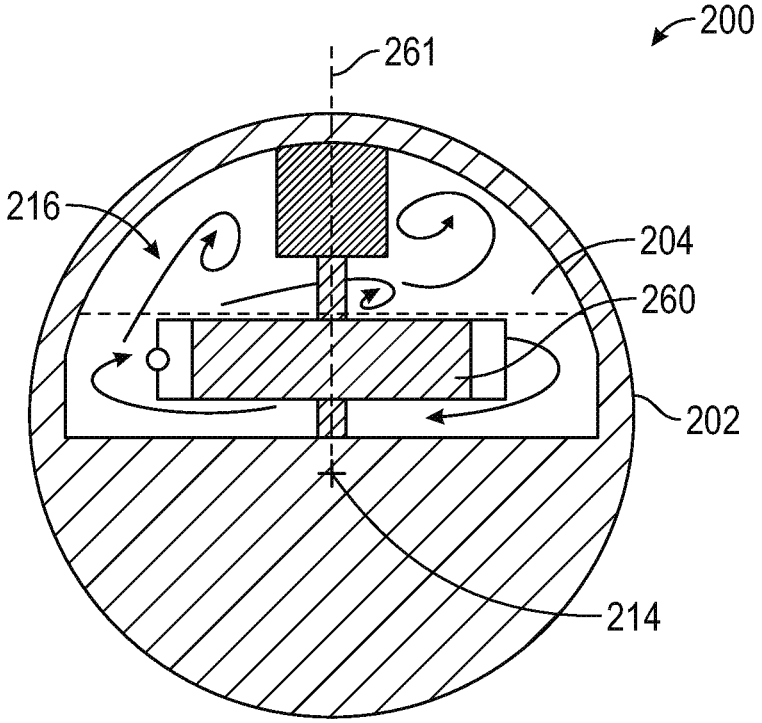
FIG. 6 is a sectional side view of the flow control device with the chamber insert omitted.

FIG. 6 is a sectional side view of the flow control device 200 with the chamber insert omitted from view. This sectional view is taken along a section plane perpendicular to a housing axis 214 ("out of the page" in FIG. 6). The turbine 260 is rotatably mounted about a turbine axis 261 that extends transversely (orthogonally in this example) to the housing axis 214. The housing 202 has a generally circular cross-sectional shape shown for fitting withing a generally circular wellbore. As a result, the turbine chamber 204 includes an arched portion 216 defined by the housing 202 over the turbine 260. Flow through the turbine chamber 204 is preferably optimized for efficiency and rotational speed for a given volumetric flow rate through the turbine chamber 204. However, the arched portion 216 forms excess open space over the turbine 260. Without the disclosed chamber insert installed, this open space over the turbine 260 may contribute to non-ideal flow patterns, such as turbulence, resulting in suboptimal speed and/or efficiency of the turbine 260.

Figure 7:
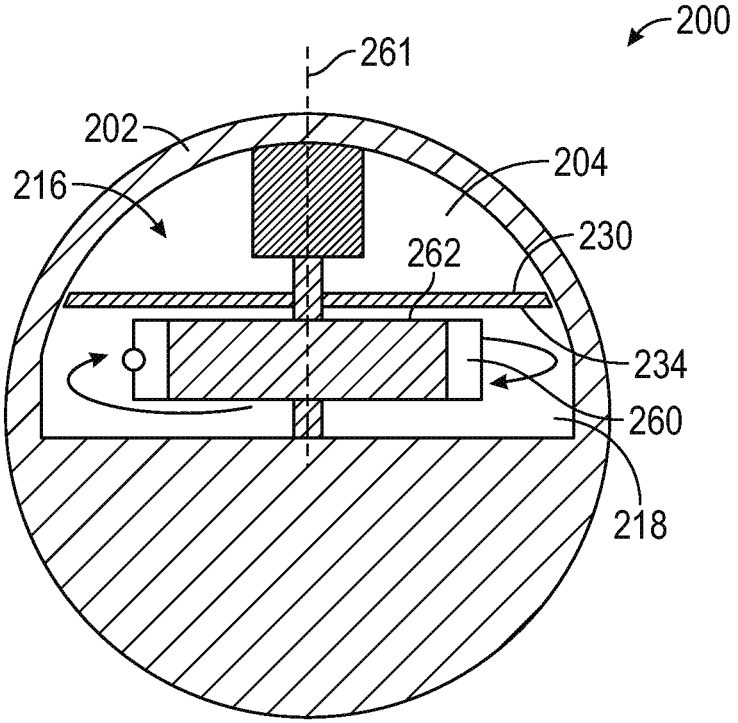
FIG. 7 is another sectional side view of the flow control device, with the chamber insert installed in the turbine chamber.

FIG. 7 is another sectional side view of the flow control device 200, with the chamber insert 230 installed in the turbine chamber 204. The overhead portion 234 of the chamber insert 230 traverses the turbine chamber 204, cordoning off the arched portion 216 of the housing 202. The ceiling 234 defined by the overhead portion 234 extends generally parallel to an upper surface 262 of the turbine 260, which is orthogonal to the turbine axis 261. Thus, flow within the turbine chamber 204 is now generally confined to a reduced chamber volume 218 below (inward of) the overhead portion 232. The reduced chamber volume 218 is a cylindrical chamber volume about the turbine 260 to provide a radial gap between the turbine 260 and the cylindrical inner diameter (ID) of the reduced chamber volume 218. The reduced chamber volume 218 is preferably coaxial with the turbine 260. Thus, flow confined to the cylindrical, reduced chamber volume 218 is more optimal with the chamber insert 230 (FIG. 7) than without (FIG. 6). For example, the flow may be better streamlined circumferentially about the turbine 260, with more laminar flow, to rotate the turbine 260 faster and more efficiently for a given volumetric flow rate through the turbine chamber 204.

Figure 8:
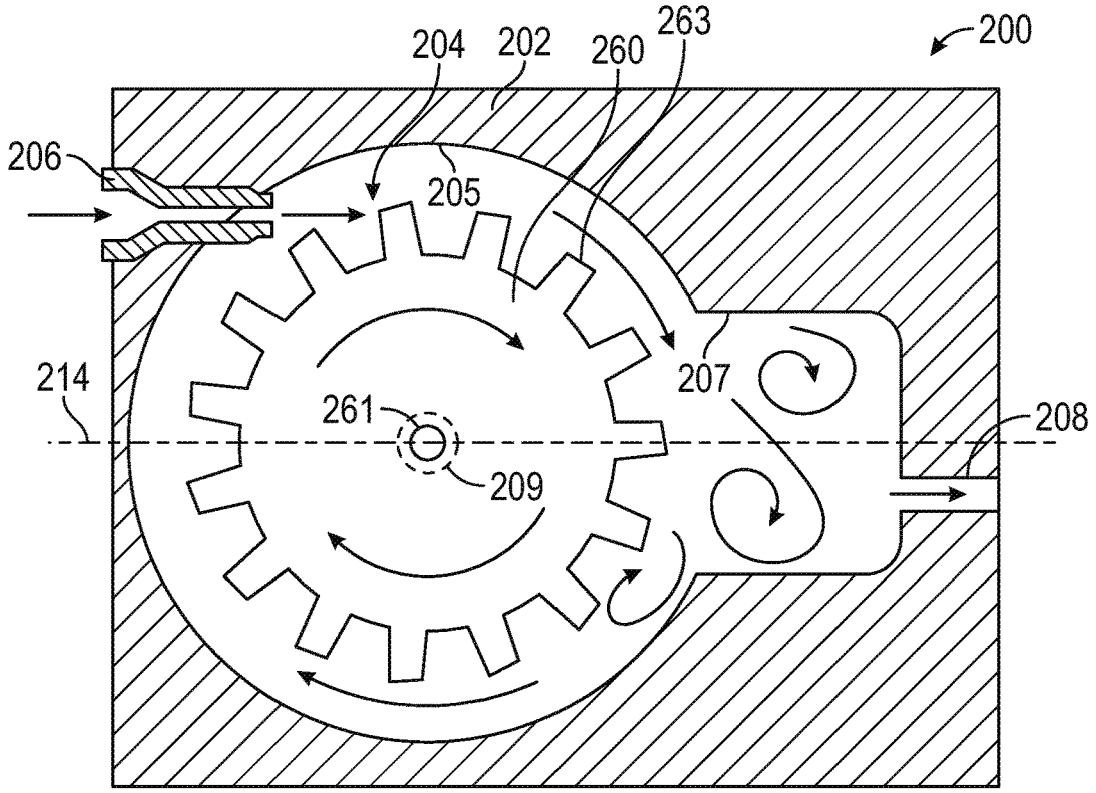
FIG. 8 is a sectional top view of the flow control device with the chamber insert removed.

FIG. 8 is a sectional top view of the flow control device 200 with the chamber insert removed. This view is taken along a section plane that is parallel to the housing axis 214 and perpendicular to the turbine axis 261. Flow of formation fluids enters the turbine chamber 204 at the inlet port 206 and may exit at different outlet ports. Some of the flow may exit the turbine chamber 204 at an outlet port serving as a bypass port 208. Some of the flow through the turbine chamber 204 may also exit at a central outlet port 209 along the turbine axis 261 (discussed further below). Flow through the bypass port 208 and at the outlet port 209 may take different paths to a production conduit. In the case of an ICD discussed below, the proportion of flow out the bypass port 208 and the central outlet port 209 may depend in part on the properties (e.g., density, viscosity) of the formation fluid or its fluid components.

FIG. 8 also shows the first arcuate portion 205 as defined by the housing 202. The first arcuate portion 205 partially encircles (less than 360 degrees) the turbine 260. The turbine chamber 204 then opens up to the cavity 207 of the turbine chamber 204 radially outward therefrom, leading to the bypass port 208. The chamber insert is removed from view in FIG. 8 leaving the cavity 207 fully open to flow through the turbine chamber 204. The presence of the cavity 207 disrupts the desired flow around the turbine 260, which may reduce the efficiency and output of the turbine 260. Without the chamber insert, flow would be relatively streamlined along the first arcuate portion 205, then becomes more turbulent as it approaches and enters the cavity 207.

Figure 9:
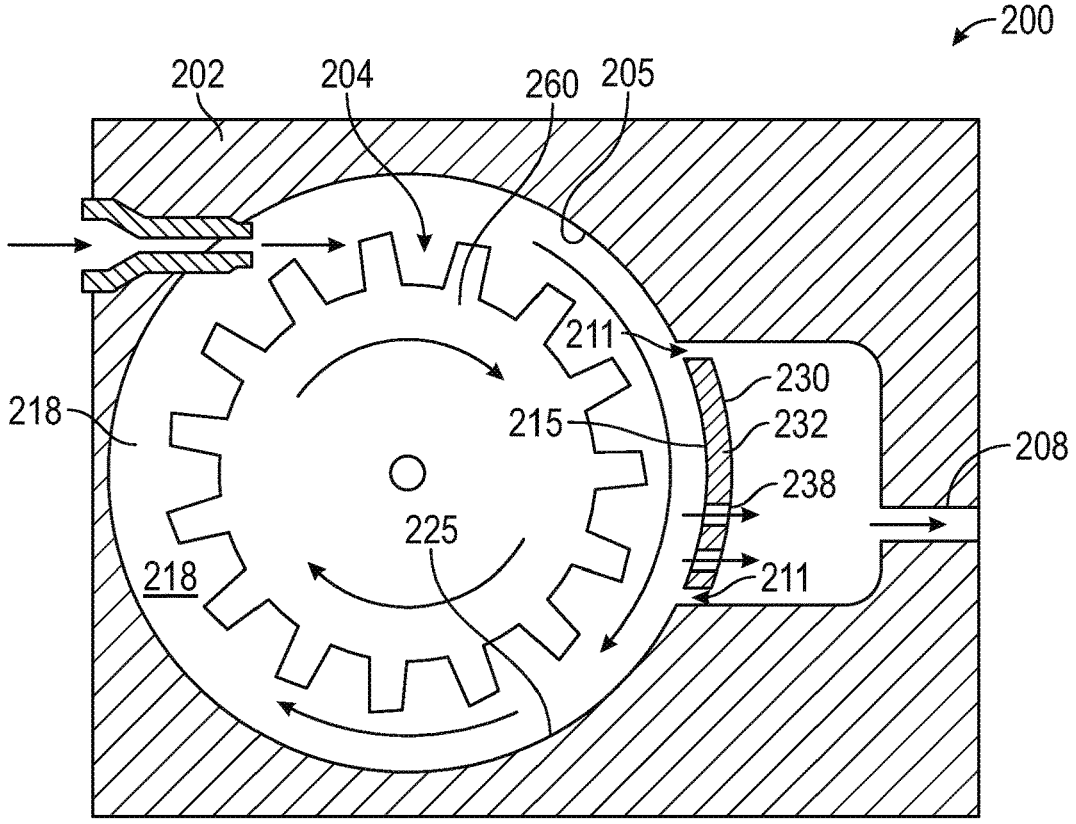
FIG. 9 is a sectional top view of the flow control device of FIG. 8, with the chamber insert installed to form the cylindrical reduced chamber volume.

FIG. 9 is a sectional top view of the flow control device 200 of FIG. 8, with the chamber insert 230 installed to form the cylindrical reduced chamber volume 218. The section plane is parallel with but below the overhead portion 232 (see FIGS. 4 and 5) of the chamber insert 230, providing a relatively unobstructed view of the turbine chamber 204 and the turbine 260 from above. The baffle 236 is radially spaced from the turbine 260 and defines the second arcuate portion 215, with the bypass port 208 in the cavity 207 being outward of the reduced chamber volume 218. The second arcuate portion 215, as defined by the baffle 236, is contiguous with the first arcuate portion 205, as defined by the housing 202. Together, the first arcuate portion 205 and second arcuate portion 215 collectively form a cylindrical wall 225 about the turbine 260 that defines a portion of the reduced chamber volume 218. The cylindrical wall 225 may span a full 360 degrees, preferably minimizing any circumferential gaps 211 between the first and second arcuate portions 205, 215. Slight circumferential gaps 211 may be present, such as to accommodate part tolerances in the baffle 236, or in other embodiments to intentionally allow some bleed-off flow to exit toward the bypass port 208 without significantly disrupting the flow about the turbine 260. However, in this example, any circumferential gaps 211 are preferably minimized, so that any flow from the reduced chamber volume 218 into the cavity 207 and to the bypass port 208 is constrained to flow through the perforations 238 in the baffle 236.

Figure 10:
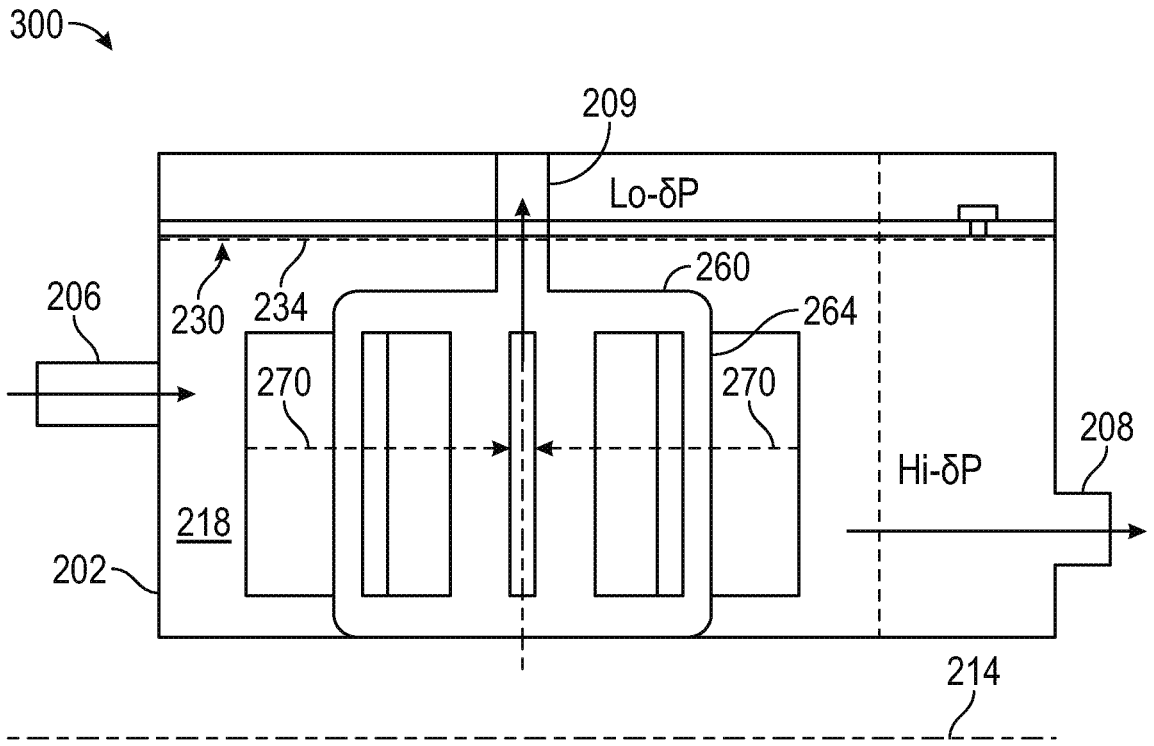
FIG. 10 is a schematic side view of an example inflow control device (ICD) incorporating the turbine, housing, and chamber insert.

FIG. 10 is a schematic side view of an example inflow control device (ICD) 300 incorporating the turbine 260, housing 202, and chamber insert 230. This section view is taken along a section plane parallel to the housing axis 214 and parallel to the turbine axis 261. As discussed above, the housing 202 and chamber insert 230 cooperatively define a reduced chamber volume 218 about the turbine 260. One or more radial flow path (in this case, a plurality of radial flow paths) 270 extend from a periphery 264 of the turbine 260 toward its center and to the outlet port 209. Flow enters the reduced chamber volume 218 through the inlet port 206, drives rotation of the turbine 260, and exits the chamber through an outlet port (bypass port) 208 in the cavity 207 and/or the central outlet port 209. The ICD 300 selectively restricts flow of higher-density (and/or lower-viscosity) fluid components by directing those fluid components predominantly toward the bypass port 208, which generates a higher pressure drop ("Hi-δP"). The ICD 300 preferentially directs more of the lower-density and/or higher-viscosity fluid components to the central outlet port 209, which generates a comparatively lower pressure drop ("Lo-δP").

A variety of configurations generally known in the art apart from the specific teachings of this disclosure may be used to provide the higher pressure drop at one outlet port and a lower pressure drop at another outlet port. For example, the higher pressure drop may be achieved by directing flow through the bypass port along a more tortuous path before reaching the production conduit. Likewise, flow through the central outlet port 209 may have a more direct path to the production conduit.

In a formation that produces significant quantities of both oil and water, the ICD 300 may be configured to restrict flow in relation to how much water is being produced. Thus, with multiple ICDs 300 placed in different production intervals, the ICDs 300 will collectively produce more oil than if formation fluids were produced at full capacity without discriminating between oil and water. In a similar respect, zones that are producing more oil than water will contribute more to the overall production of formation fluid than zones that are producing more water than oil.

Figure 11:
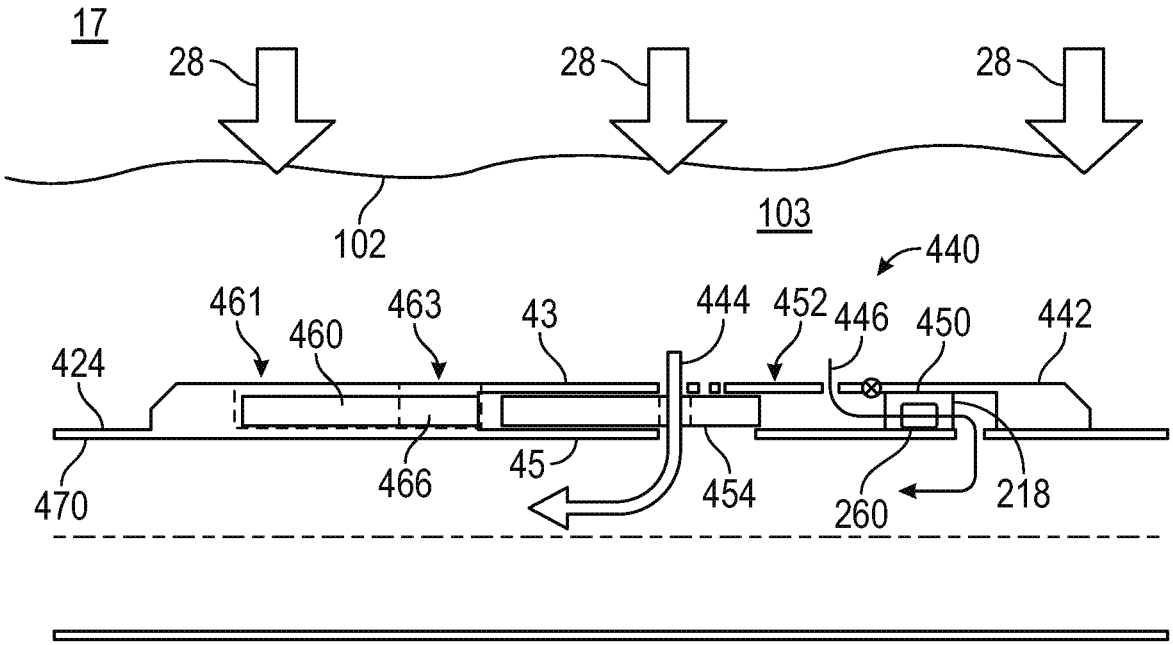
FIG. 11 is a schematic side view of a flow control system that uses the turbine to generate electrical power.

One or more radial flow path (in this case, a plurality of radial flow paths) 270 extend from a periphery 264 of the turbine 260 toward its center. FIG. 11 is a schematic side view of a flow control system 440 that uses the turbine 260 to generate electrical power. The flow control system 440 includes a flow control body (i.e., housing) 442, an on-board electrical generator 450, a valve closure (i.e., closure) 452 moveably coupled to the housing 442, an electronics package 460, and an actuator 466. The generator 450 incorporates the turbine 260 that may be rotatably secured within a turbine housing and reduced chamber volume 218 according to any of the foregoing examples. The electronics package 460 may include various electronic components such as a local, wireless transmitter/receiver used to communicate with other components of the smart well node system, a local (on-board) controller comprising a processor (i.e., a local processor) and control logic for controlling operation of on-board components, an optional battery pack, and various sensors or peripherals.

The closure 452 is moveable with respect to the housing 442 for controlling flow through the housing 442 along one or more flow paths through the housing 442. The actuator 466 is used to drive the closure 452 in order to control flow of formation fluids at that location. The electronics package 460 and the actuator 466 are examples of downhole components that require electrical power. In an example configuration, the electronics package 460 may be modular. The modular electronics package 460 may be preconfigured with components selected specific to a particular system or desired tool configuration. The modular electronics package may be removably securable such as by inserting laterally in an exterior side pocket 461 of the housing 442, wherein the housing 442 may comprise a mandrel having the side pocket 461. Upon insertion into the side pocket 461, the modular electronics package 460 may automatically physically couple to the flow control body (e.g., by snapping in) and/or electrically connect to a portion of an electrical power grid within a larger smart node well system. The actuator 466 may also be modular and similarly secured to a respective side pocket 463.

The housing 442 is fluidly coupled to a production conduit 470, defining an annulus 103 between the housing 442 and the wellbore 102. Formation fluid 28 flows from the formation 17 into the annulus 103 and from the annulus 103 into the production conduit 470 through the flow control system 440. The production conduit 470 may comprise production tubing 424 and/or other tubular members for conveying formation fluid 28 to surface. A portion of the production conduit 470 may also be defined by the housing 442 and other components fluidly coupled to the housing 442, such as a base pipe of a sand control assembly. The housing 442 may be generally round or tubular to conform with the wellbore 102 and to position around or otherwise in-line with production tubing 424.

The housing 442 defines at least one primary flow path 444 extending from an exterior 43 of the housing 442 to an interior 45 of the housing 442 for producing formation fluids 28 into the production conduit 470. The primary flow path 444 shown may be one of a plurality of primary flow paths circumferentially spaced for entry of the formation fluids 28 into the production conduit 470. A portion of the flow through the housing 442 is also directed through the generator 450. In this example, the flow through the generator 450 is directed through the housing 442 along one or more secondary flow path 446 spaced from the primary flow path 444. Alternatively, the primary flow path 444 could be diverted inside the flow control system 440 along one or more secondary flow path to the generator 450. In either case, flow through the generator 450 may be expelled into the production conduit 470 along with other produced formation fluids. The closure 452 is operable using the actuator 466 to adjust the flow of the formation fluids 28 through the primary and secondary flow paths 444, 446 of the housing 442.

The disclosed apparatuses enable a number of methods involving the use of a turbine in a flow control device in a well. In one example, a method of producing formation fluid in a well comprises positioning a chamber insert in a turbine chamber to form a reduced chamber volume. Flow of the formation fluid is directed through the reduced chamber volume in the turbine chamber and to a production conduit of the well. The flow through the reduced chamber volume is used to rotate a turbine rotatably disposed in the turbine chamber. More particularly, the flow in the reduced chamber volume may be directed along a cylindrical surface cooperatively defined by a first arcuate wall portion of the housing and a second arcuate wall portion of the chamber insert. The chamber insert may comprise one or both of a ceiling over the turbine and a perforated baffle radially outward of the turbine. Again, a perforated baffle portion or other permeable member may be omitted in some cases, as discussed above. The method may include directing a portion of the flow in the turbine chamber through an outlet port to the production conduit, and directing another portion of the flow through perforations in the baffle to a bypass port.

The turbine rotation may be used in a variety of applications. In one example, flow may be directed through the turbine to an outlet port or around the turbine to a bypass port. A proportion of the flow through the outlet port and the bypass port may be controlled in relation to a density of one or more fluid components of the flow. Controlling the proportion of the flow through the outlet port and the bypass port may include directing some of the flow along a radial flow path from a periphery of the turbine toward a center of the turbine. A float component within the radial flow path may be moved in relation to the density of the one or more fluid components to move the float component between an open position that enables fluid flow along the radial flow path to the outlet port and a closed position that restricts fluid flow along the radial flow path to the outlet port. Another method may use rotation of the turbine to generate electrical power in response to the rotation of the turbine.

Various examples of a downhole flow control device have been provided, wherein flow through a turbine chamber is optimized using a chamber insert. The disclosed principles may be applied to any of a variety of downhole applications. The examples discussed above include inflow control devices and downhole electrical power generators for on-board components. Other configurations may combine applications. For example, a flow control device according to this disclosure may be configured so that a turbine is used both as an ICD and for electrical power generation. The various systems, apparatus, methods, and other constructs may include any suitable combination of the features disclosed herein, including one or more of the following examples.

Example 1. A flow control device for a well, comprising: a housing positionable in a well, the housing having a turbine chamber with an inlet port and an outlet port for fluid communication with a production conduit; a turbine rotatably disposed in the turbine chamber with the inlet port directed toward the turbine; and a chamber insert removably securable in the turbine chamber to cooperatively define a reduced chamber volume with the turbine chamber.

Example 2. The flow control device of Example 1, wherein the reduced chamber volume is a cylindrical chamber volume about the turbine.

Example 3. The flow control device of Example 2, wherein the cylindrical chamber volume comprises a first arcuate wall portion defined by the housing and a second arcuate wall portion defined by the chamber insert.

Example 4. The flow control device of any of Examples 1 to 3, wherein the chamber insert comprises an overhead portion defining a ceiling over the turbine and a perforated baffle defining a portion of the reduced chamber volume.

Example 5. The flow control device of Example 4, wherein the ceiling has a generally flat structure that traverses the turbine chamber parallel to a top face of a turbine.

Example 6. The flow control device of Example 4 or 5, further comprising:

one or more arcuate vanes extending from the ceiling to guide flow through the turbine chamber.

Example 7. The flow control device of any of Examples 4 to 6, further comprising a bypass port in the turbine chamber outward of the reduced chamber volume, wherein perforations of the perforated baffle are in fluid communication with the bypass port.

Example 8. The flow control device of any of Examples 4 to 7, wherein the turbine is rotatably mounted about a turbine axis transverse to a housing axis, wherein the turbine chamber comprises an arched portion defined by the housing over the turbine, and wherein the ceiling of the chamber insert traverses the arched portion perpendicular to a turbine axis.

Example 9. The flow control device of any of Examples 1 to 8, further comprising: an inflow control device for directing flow through different outlet ports based on a density of fluid components.

Example 10. The flow control device of Example 9, wherein the different outlet ports comprise a central outlet port and the turbine comprises a plurality of radial flow paths in fluid communication with the central outlet port.

Example 11. The flow control device of Example 9 or 10, wherein the different outlet ports comprise a bypass port radially outward of the reduced chamber volume, wherein flow exiting the turbine chamber through the central outlet port experiences a lower pressure drop than flow exiting the turbine chamber through the bypass port.

Example 12. The flow control device of any of Examples 1 to 11, further comprising an electrical generator that generates electrical power in response to the rotation of the turbine.

Example 13. The flow control device of Example 1, wherein rotation of the turbine selectively restricts the flow of lower density fluid components while simultaneously generating electrical power downhole.

Example 14. A method of controlling flow of formation fluid produced by a well, the method comprising: positioning a chamber insert in a turbine chamber to cooperatively define a reduced chamber volume about a turbine; directing a flow of the formation fluid through the reduced chamber volume to a production conduit of the well; and using the flow through the reduced chamber volume to rotate a turbine rotatably secured in the turbine chamber.

Example 15. The method of Example 14, wherein cooperatively defining the reduced chamber volume about the turbine comprises forming a cylindrical chamber by positioning a second arcuate wall portion defined by a baffle of the chamber insert contiguous with a first arcuate wall portion defined by a housing.

Example 16. The method of Example 15, wherein cooperatively defining the reduced chamber volume comprises traversing an arched portion of the housing with an overhead portion of the chamber insert to define a ceiling over the turbine and positioning a perforated baffle radially outward of the turbine.

Example 17. The method of Example 16, further comprising directing a portion of the flow along radial flow paths in the turbine to a central outlet port, and directing another portion of the flow through perforations in the baffle to a bypass port.

Example 18. The method of Example 17, further comprising controlling a proportion of the flow to the central outlet port and a proportion of the flow to the bypass port in relation to a density of one or more fluid components of the flow.

Example 19. The method of any of Examples 14 to 18, further comprising: generating electrical power in response to the rotation of the turbine.

Example 20. The method of any of Examples 14 to 19, further comprising: using rotation of the turbine to control a proportion of the flow along radial flow paths in the turbine to a central outlet port and to a bypass port in relation to a density of the flow; and simultaneously generating electrical power in response to the rotation of the turbine.

What is claimed is:

1. A flow control device for a well, comprising:

a housing positionable in a well, the housing having a turbine chamber with an inlet port and an outlet port for fluid communication with a production conduit;

a turbine rotatably disposed in the turbine chamber with the inlet port directed toward the turbine; and a chamber insert removably securable in the turbine chamber to cooperatively define a reduced chamber volume with the turbine chamber, wherein the chamber insert comprises a perforated baffle, and wherein the perforated baffle comprises a plurality of perforations.

2. The flow control device of claim 1, wherein the reduced chamber volume is a cylindrical chamber volume about the turbine.

3. The flow control device of claim 2, wherein the cylindrical chamber volume comprises a first arcuate wall portion defined by the housing and a second arcuate wall portion defined by the chamber insert.

4. The flow control device of claim 1, wherein the chamber insert further comprises an overhead portion defining a ceiling over the turbine.

5. The flow control device of claim 4, wherein the ceiling has a generally flat structure that traverses the turbine chamber parallel to a top face of a turbine.

6. The flow control device of claim 4, further comprising:

one or more arcuate vanes extending from the ceiling to guide flow through the turbine chamber.

7. The flow control device of claim 1, further comprising a bypass port in the turbine chamber outward of the reduced chamber volume, wherein the plurality of perforations of the perforated baffle are in fluid communication with the bypass port.

8. The flow control device of claim 1, further comprising:

an inflow control device for directing flow through different outlet ports based on a density of fluid components.

9. The flow control device of claim 8, wherein the different outlet ports comprise a central outlet port and the turbine comprises a plurality of radial flow paths in fluid communication with the central outlet port.

10. The flow control device of claim 8, wherein the different outlet ports comprise a bypass port radially outward of the reduced chamber volume, wherein flow exiting the turbine chamber through the central outlet port experiences a lower pressure drop than flow exiting the turbine chamber through the bypass port.

11. The flow control device of claim 1, further comprising an electrical generator that generates electrical power in response to the rotation of the turbine.

12. The flow control device of claim 1, wherein rotation of the turbine selectively restricts the flow of lower density fluid components while simultaneously generating electrical power downhole.

13. A flow control device for a well, comprising:

a housing positionable in a well, the housing having a turbine chamber with an inlet port and an outlet port for fluid communication with a production conduit;

a turbine rotatably disposed in the turbine chamber with the inlet port directed toward the turbine, wherein the turbine is rotatably mounted about a turbine axis transverse to a housing axis, a chamber insert removably securable in the turbine chamber to cooperatively define a reduced chamber volume with the turbine chamber, wherein the chamber insert comprises an overhead portion defining a ceiling over the turbine and a perforated baffle defining a portion of the reduced chamber volume, wherein the turbine chamber comprises an arched portion defined by the housing over the turbine, and wherein the ceiling of the chamber insert traverses the arched portion perpendicular to a turbine axis.

14. A method of controlling flow of formation fluid produced by a well, the method comprising:

positioning a chamber insert in a turbine chamber to cooperatively define a reduced chamber volume about a turbine, wherein the chamber insert comprises a perforated baffle positioned radially outward from the turbine, and wherein the perforated baffle comprises a plurality of perforations;

directing a flow of the formation fluid through the reduced chamber volume to a production conduit of the well; and using the flow through the reduced chamber volume to rotate a turbine rotatably secured in the turbine chamber.

15. The method of claim 14, wherein cooperatively defining the reduced chamber volume about the turbine comprises forming a cylindrical chamber by positioning a second arcuate wall portion defined by a baffle of the chamber insert contiguous with a first arcuate wall portion defined by a housing.

16. The method of claim 15, wherein cooperatively defining the reduced chamber volume comprises traversing an arched portion of the housing with an overhead portion of the chamber insert to define a ceiling over the turbine.

17. The method of claim 16, further comprising directing a portion of the flow along radial flow paths in the turbine to a central outlet port, and directing another portion of the flow through the plurality of perforations in the perforated baffle to a bypass port.

18. The method of claim 17, further comprising controlling a proportion of the flow to the central outlet port and a proportion of the flow to the bypass port in relation to a density of one or more fluid components of the flow.

19. The method of claim 14, further comprising:

generating electrical power in response to the rotation of the turbine.

20. The method of claim 14, further comprising:

using rotation of the turbine to control a proportion of the flow along radial flow paths in the turbine to a central outlet port and to a bypass port in relation to a density of the flow; and simultaneously generating electrical power in response to the rotation of the turbine.

* * * * *